US006644166B2

(12) United States Patent
Alexander et al.

(10) Patent No.: US 6,644,166 B2
(45) Date of Patent: Nov. 11, 2003

(54) EXPLOSIVES DISRUPTER

(75) Inventors: Graham Herbert Alexander, Blacklick, OH (US); Jeffrey Taylor Stroup, Upper Arlington, OH (US); James Patrick LaBine, Powell, OH (US); Bradley Gene DeRoos, Dublin, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 10/264,739

(22) Filed: Oct. 4, 2002

(65) Prior Publication Data

US 2003/0041722 A1 Mar. 6, 2003

Related U.S. Application Data

(63) Continuation of application No. 09/443,636, filed on Nov. 19, 1999, now Pat. No. 6,490,957.

(51) Int. Cl.[7] ..... F42B 33/00

(52) U.S. Cl. ..... 86/50; 42/94; 89/1.14; 89/37.03; 89/37.04; 102/275.06; 102/275.11; 102/293; 248/160

(58) Field of Search ..... 102/230, 275.06, 102/275.11, 293; 89/1.14, 27.3, 37.03, 37.04; 86/49, 50; 42/69.01, 77, 70.08, 94; 588/202, 203; 248/160

(56) References Cited

U.S. PATENT DOCUMENTS

| | | | | |
|---|---|---|---|---|
| 599,543 A | * | 2/1898 | Whitaker | 248/160 |
| 1,147,890 A | | 7/1915 | Purcell | |
| 1,297,891 A | | 3/1919 | Moor | |
| 3,117,518 A | | 1/1964 | Porter et al. | |
| 4,046,055 A | | 9/1977 | McDanolds et al. | |
| 4,062,112 A | | 12/1977 | Lake | |
| 4,169,403 A | | 10/1979 | Hanson | |
| 4,345,398 A | | 8/1982 | Pickett | |
| 4,393,614 A | | 7/1983 | Pickett | |
| 4,664,033 A | | 5/1987 | Burkdoll et al. | |
| 4,779,511 A | | 10/1988 | Proctor et al. | |
| 4,957,027 A | | 9/1990 | Cherry | |
| 5,105,570 A | | 4/1992 | Lishness et al. | |
| 5,134,921 A | | 8/1992 | Breed et al. | |
| 5,210,368 A | | 5/1993 | Heller, Jr. et al. | |
| 5,276,596 A | | 1/1994 | Krenzel | |
| 5,421,119 A | | 6/1995 | Miner | |
| 5,449,206 A | | 9/1995 | Lockwood | |
| 5,460,154 A | | 10/1995 | Mattern et al. | |
| 5,515,767 A | | 5/1996 | Gilbert | |
| 5,613,315 A | | 3/1997 | Hunziker | |
| 5,697,181 A | | 12/1997 | Savant | |
| 6,490,957 B1 | * | 12/2002 | Alexander et al. | 86/50 |

FOREIGN PATENT DOCUMENTS

| | | |
|---|---|---|
| DE | 30 05 919 A1 | 10/1981 |
| DE | 39 37 464 A1 | 5/1991 |

* cited by examiner

*Primary Examiner*—Harold J. Tudor
(74) *Attorney, Agent, or Firm*—William B. Richards; Courtney J. Miller

(57) ABSTRACT

A portable explosives disrupter for de-arming improvised explosive devices includes a barrel for housing a projectile, a mechanism for firing the projectile from the barrel, a breech which may be adapted to house a variety of firing mechanisms, a light-weight, semi-rigid, three-dimensionally flexible, recoil-absorbing system for orienting the device in relation to a target and minimizing the effects of recoil on the accuracy of the device, and a means for accurately aiming the explosives disrupter at a target. Three different firing mechanisms are provided, the first employing a firing pin and shock tubing, the second employing a metal sphere and shock tubing, and the third employing a firing piston and a source of compressed air.

11 Claims, 7 Drawing Sheets

EXPLOSIVES DISRUPTER

This application is a continuation of, and claims benefit of priority to, U.S. application Ser. No. 09/443,636, filed Nov. 19, 1999, now U.S. Pat. No. 6,490,957, issued Dec. 10, 2002. The entire contents of the abovementioned application, including the Specification, claims, Abstract, and Drawings, is hereby incorporated herein by reference as if fully rewritten herein.

This invention was made with government support under Contract No. N39998-98-D-3563 awarded by The Office of Special Technology (Department of Navy). The Government has certain rights in this invention.

FIELD OF THE INVENTION

This invention relates to projectile-firing devices used for disabling or de-arming explosive devices, their method of making, and method of use.

BACKGROUND OF THE INVENTION

Military and law enforcement personnel who work in bomb disposal units are frequently required to contend with improvised explosive devices or IEDs. IEDs include pipe bombs, letter bombs, hand grenades, land mines, bombs in small packages, and trip-wire devices. The dangerous task of de-arming such devices is often exacerbated by the emplacement of IEDs in challenging positions or orientations. For example, an IED may be partially buried, hidden in a recess such as a mailbox, or taped to the bottom of a table, desk, or chair. IEDs are terrorist devices, and as such, are frequently found in highly populated areas where de-arming the device greatly increases the risk of collateral damage to both people and property.

A variety of devices may be used for disrupting or de-arming improvised explosive devices. McDonald, U.S. Pat. No. 4,046,055 discloses a de-armer that neutralizes an IED by first piercing the exterior of the device with an explosively-driven captive projectile and then injecting liquid nitrogen into the device. Lake, U.S. Pat. No. 4,062,112 discloses a wire cutter which inactivates bombs by utilizing an explosively actuated piston situated within a barrel to sever bomb wires. Hanson, U.S. Pat. No. 4,169,403 uses a liquid missile fired at a high velocity to breach the housing of bomb and wet the contents to prevent or disrupt detonation of the bomb. Proctor, U.S. Pat. No. 4,779,511 discloses a prefabricated, single-use, disposable de-armer that utilizes a propellant charge mounted in a tube adjacent to a slug which is fired at the fuse mechanism of a bomb. Cherry, U.S. Pat. No. 4,957,027 discloses a multi-barrel de-armer that requires shock tubing to fire a small arms cartridge into an explosive device. Heller, U.S. Pat. No. 5,210,368 discloses a tripod-mounted, electrically activated de-armer that fires a shotgun shell at an explosive device, and Gilbert, U.S. Pat. No. 5,515,767 discloses a recoil-absorbing de-armer which fires a projectile from a barrel by means of an explosive charge placed behind the projectile.

Despite the availability of the de-arming devices described above, these devices are all subject to significant limitations. For example, most of these devices are too large or cumbersome to be useful in situations where open access to the target is unavailable or extremely limited. Furthermore, accurately aiming and orienting one of these de-armers in relation to a target may be difficult if not impossible, due to a lack of flexibility of the device, or the lack of a means by which to accurately aim the de-armer if the barrel cannot be placed directly against the target.

Additionally, most projectile-firing de-armers require explosive shock tubing as part of the firing train. The use of shock tubing may not be economical because a significant length of tubing is often required, and once the de-armer is fired the tubing must be replaced before the de-armer can be fired again.

BRIEF DESCRIPTION OF THE INVENTION

According, these and other disadvantages of the prior art are overcome by the present invention which provides a remotely-activated explosives disrupter comprising a projectile housed within a cylindrical barrel which is securely mounted on a semi-rigid, segmented, flexible support system. The support system of this invention provides flexibility in orienting the explosives disrupter relative to a target and minimizes the effects of recoil on accuracy when the device is fired. The firing train of this invention utilizes either shock tubing and a firing pin, shock tubing and a metal sphere, or compressed air and a firing piston to fire the projectile from the barrel. Providing standoff distance, as well as aiming the present invention, is accomplished either by inserting standoff spokes into the muzzle end of the barrel, or adding extension tubing to either end of the barrel. The individual component parts of this invention are disassembled and packaged as a kit which is portable and easily carried into the field where the explosives disrupter may rapidly be assembled and deployed.

Therefore, the principal object of the present invention is to provide a portable, adjustable explosives disrupter that will allow bomb disposal technicians to prevent the detonation of an IED by accurately cutting, severing, jamming, gagging, or disrupting the firing train of concealed or otherwise screened threat items.

Another object of this invention is to provide an explosives disrupter which uses a disposable metal sphere in place of a firing pin in the firing mechanism, thereby eliminating the need to clean the firing pin each time the de-armer is fired.

Still another object of this invention is to provide an explosives disrupter which uses a non-explosive compressed-air firing mechanism in place of an explosive shock tubing, thereby making the device less expensive to use while increasing overall safety.

Further objects, advantages, and novel aspects of this invention will become apparent from a consideration of the drawings and subsequent detailed description.

Reference Numerals

10 Explosives Disrupter
12 Barrel
14 Breech
16 Firing Mechanism
18 Union
20 Compression Fitting (Ferrule Nut)
22 Propellant Conduit
24 Charge Source
26 Projectile
28 Orienting Apparatus
30 Clamp
31 Nut
32 Clamp Knob
33 Adapter
34 Flexible Support
36 Stake
40 Firing Pin
42 Plug

44 Spring
46 Cylindrical Bore
50 Metal Sphere
52 O-Ring
54 Retainer
60 Firing Piston
61 Retaining Ring
62 Ball bearing
63 Slider
64 Resistance Coil
66 Spring Chamber
70 Extension Tubing
72 Standoff Spoke
80 Target
90 Container

BRIEF DESCRIPTION OF THE DRAWINGS

FIG. 5*a* also depicts the placement of the clamp and clamp knob.

FIG. 5*a* also depicts the placement of the clamp and clamp knob.

DETAILED DESCRIPTION OF THE INVENTION AND BEST MODE

Figure 1:
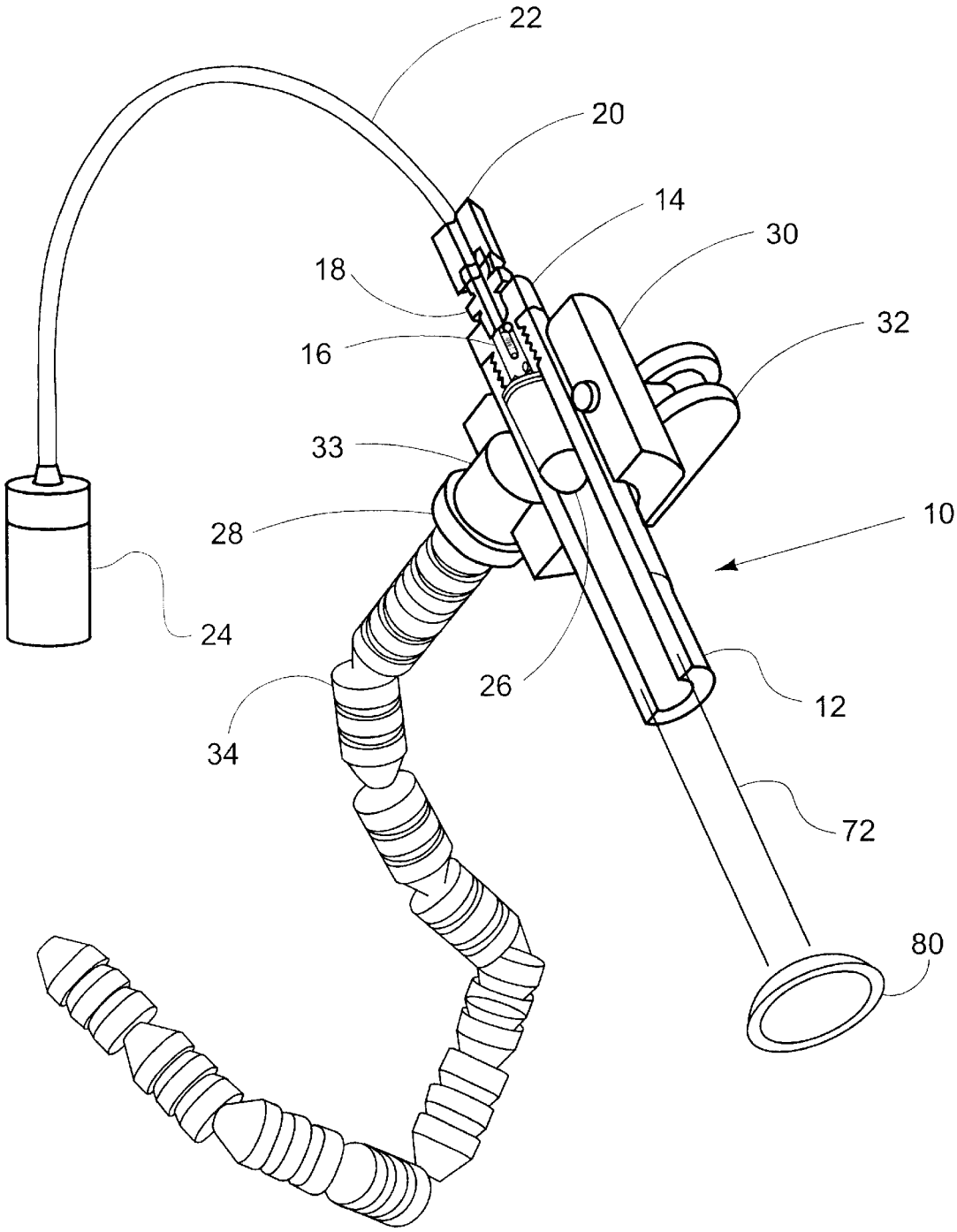
FIG. 1 is a cross-sectional view of the assembled device according to the teachings of the present invention. In this illustration, the standoff spokes are inserted into the barrel and the explosives disrupter has been oriented toward, and aimed at, a target.

As best shown in FIG. 1, a explosives disrupter 10 according to a preferred embodiment of the present invention comprises a cylindrical barrel 12 which, at one end, threadably receives breech 14 which houses firing mechanism 16. Breech 14 threadably receives union 18, which in turn threadably receives compression fitting 20. Projectile 26 is housed within barrel 12 and prior to being fired, rests against the front end of breech 14. Propellant conduit 22 passes through compression fitting 20 and union 18 such that one terminus of propellant conduit 22 rests against the back end of firing mechanism 16. The other terminus of propellant conduit 22 is attached to charge source 24. The energy required to forcibly drive firing mechanism 16 into the primer of projectile 26 is provided by propellant conduit 22 which is activated by the charge provided by charge source 24.

Firing mechanism 16 is a sub-assembly comprising a means for striking the primer of projectile 26 with the force required to fire projectile 26 from barrel 12. Breech 14 may be adapted to house various embodiments of firing mechanism 16.

Figure 2:
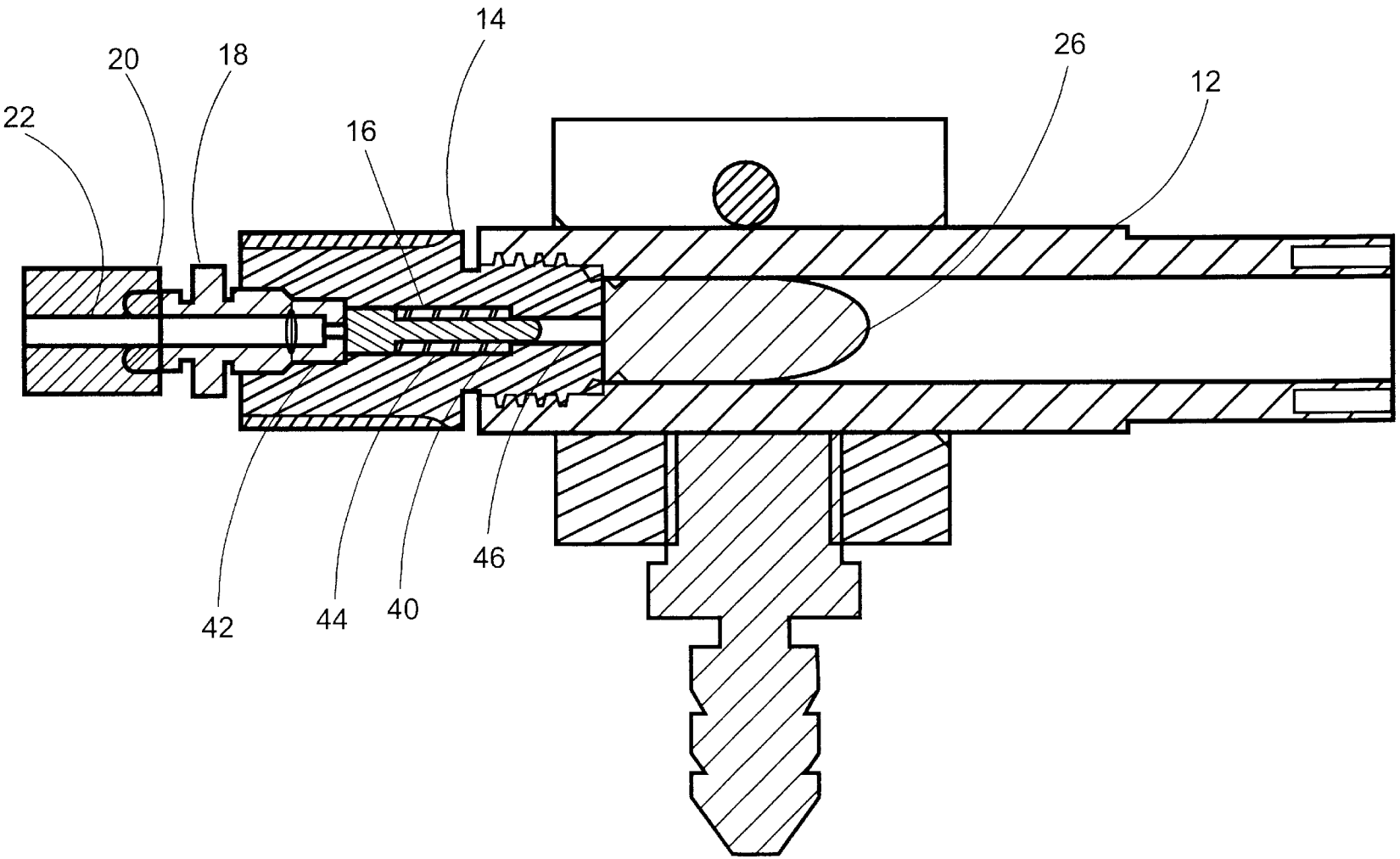
FIG. 2. is a cross-sectional view of the barrel and breech portion of the explosives disrupter shown in FIG. 1 depicting an embodiment utilizing a shock tubing and firing pin firing train.

As shown in FIG. 2, in one embodiment of the present invention firing pin 40 rests in a retracted position within cylindrical bore 46, and is encircled by spring 44. Spring 44 provides resistance to firing pin 40 and retains firing pin 40 in a retracted position in cylindrical bore 46 until explosives disrupter 10 is fired. One terminus of propellant conduit 22 extends through both compression fitting 20 and union 18 and rests against plug 42, which in turn rests against the back end of firing pin 40. Compression fitting 20 is tightened onto union 18 to hold propellant conduit 22 against plug 42. The other terminus of propellant conduit 22 is attached to charge source 24. Energy from propellant conduit 22 causes firing pin 40 to overcome the resistance of spring 44, travel down cylindrical bore 46 and forcibly strike the primer of projectile 26 causing projectile 26 to exit barrel 12 at a high velocity.

Figure 3:
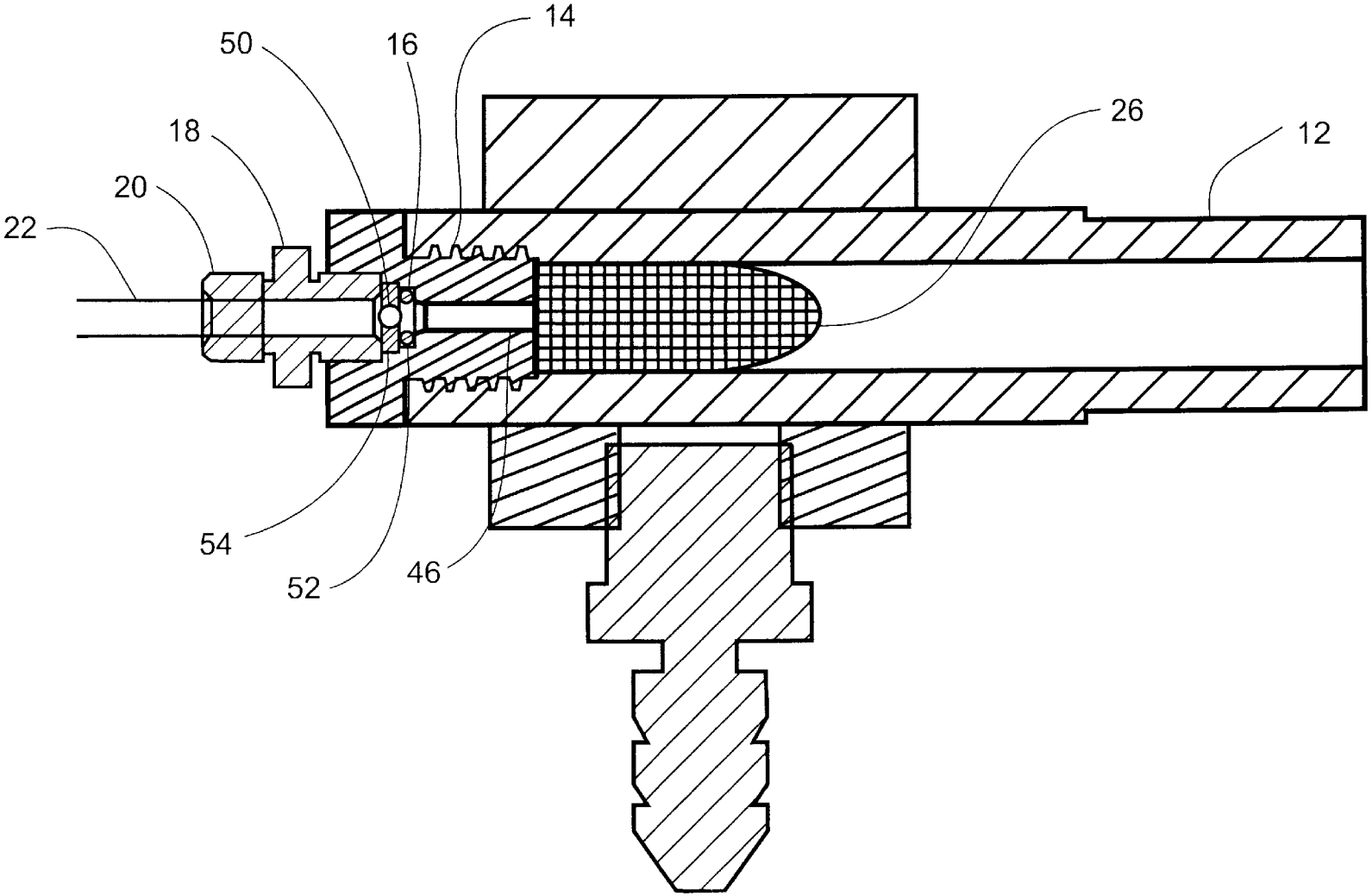
FIG. 3 is a cross-sectional view of the barrel and breech portion of the explosives disrupter shown in FIG. 1 depicting an embodiment utilizing a shock tubing and metal sphere firing train.

As shown in FIG. 3, in another embodiment of the present invention metal sphere 50 resides within cylindrical bore 46, and is encircled by retainer 54 which immobilizes metal sphere 50 within cylindrical bore 46. O-ring 52 is secured within cylindrical bore 46 and rests against the front end of metal sphere 50 to provide resistance to metal sphere 50 until explosives disrupter 10 is fired. One terminus of propellant conduit 22 extends through both compression fitting 20 and union 18 and rests against the back end of metal sphere 50. Compression fitting 20 is tightened onto union 18 to hold propellant conduit 22 against metal sphere 50. The other terminus of propellant conduit 22 is attached to charge source 24. Upon receiving energy from propellant conduit 22, metal sphere 50 overcomes the resistance of O-ring 52 and travels down cylindrical bore 46 where it forcibly strikes the primer of projectile 26 causing projectile 26 to exit barrel 12 at a high velocity.

Figure 4:
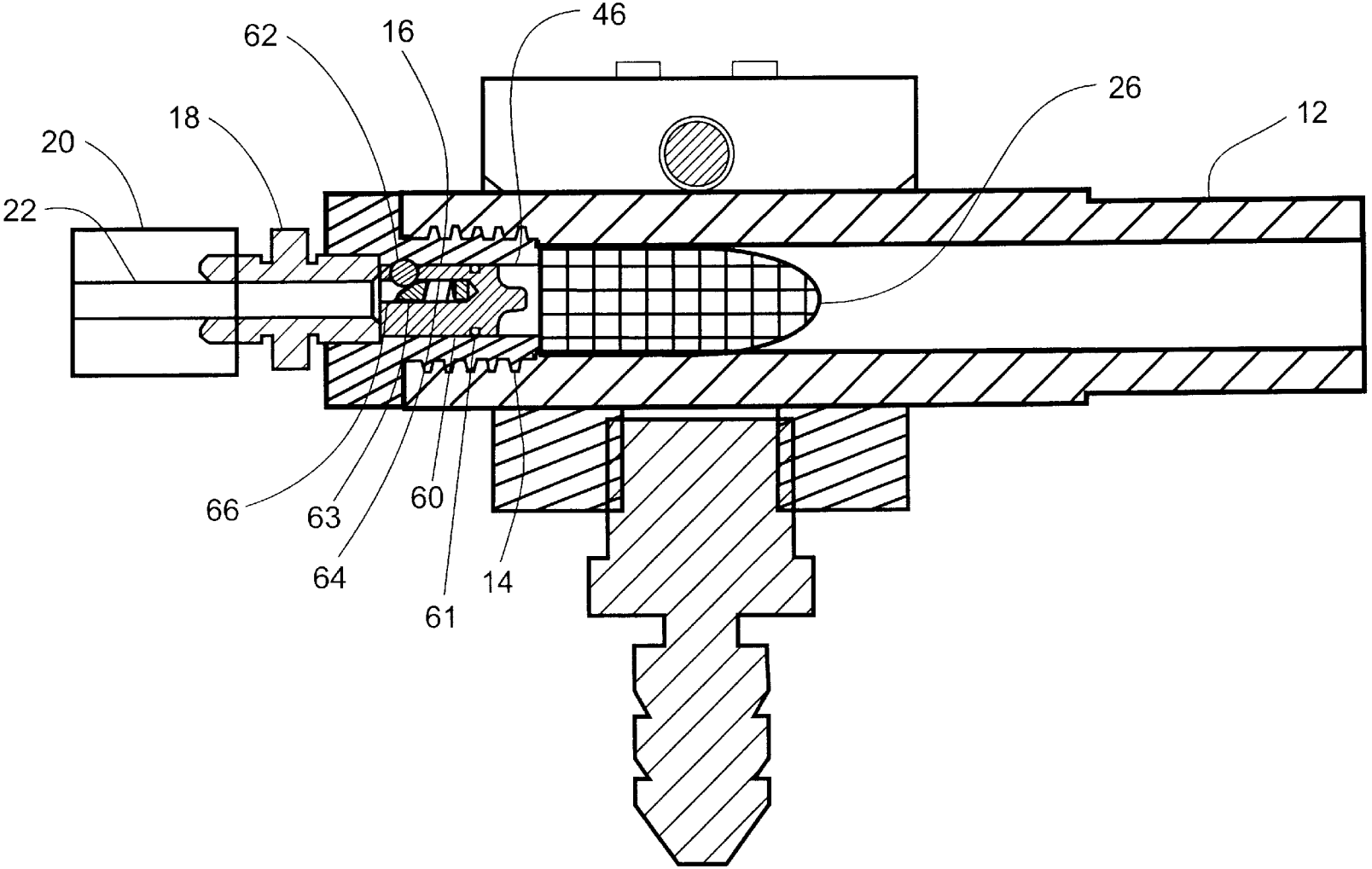
FIG. 4 is a cross-sectional view of the barrel and breech portion of the explosives disrupter shown in FIG. 1 depicting an embodiment utilizing a compressed air and firing piston firing train.

As shown in FIG. 4, in another embodiment of the present invention firing piston 60 rests in a retracted position within cylindrical bore 46, and is held in place by retaining ring 61. Firing piston 60 comprises at least one spring chamber 66 with slider 63 and resistance coil 64 residing therein. Cylindrical bore 46 is recessed to accommodate ball bearing 62 which also partially resides in spring chamber 66. The front of ball bearing 62 rests against slider 63 which in turn rests against resistance coil 64.

Resistance provided by resistance coil 64 secures ball bearing 62 between cylindrical bore 46 and spring chamber 66 thereby retaining firing piston 60 in a retracted position until explosives disrupter 10 is fired. One terminus of propellant conduit 22 extends through both compression fitting 20 and union 18 and rests against the back end of firing piston 60. Compression fitting 20 is tightened onto union 18 to hold propellant conduit 22 against firing piston 60. The other terminus of propellant conduit 22 is attached to charge source 24. Upon receiving energy in the form of compressed air through propellant conduit 22, the resistance of resistance coil 64 and retaining ring 61 is overcome, slider 63 moves forward, and ball bearing 62 is forced completely into spring chamber 66. Firing piston 60 then travels down cylindrical bore 46 and forcibly strikes the primer of projectile 26 causing projectile 26 to exit barrel 12 at high velocity. In this embodiment of the present invention, charge source 24 is the actual source of the energy which ultimately fires explosives disrupter 10; propellant conduit 22 is simply the conduit through which compressed air travels to firing mechanism 16.

Figure 5A:
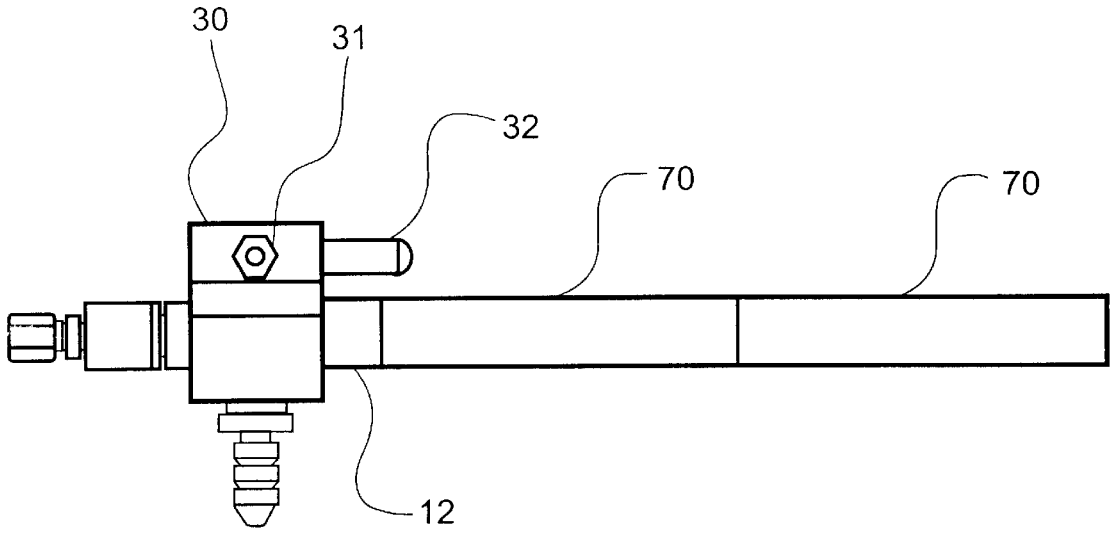
FIG. 5*a* depicts a side view of the device shown in FIG. 1 with two sections of extension tubing attached to the muzzle end of the barrel portion.

FIGS. 1 and 5*a* show explosives disrupter 10 secured within orienting apparatus 28 by clamp 30. Clamp 30 may be tightened by turning clamp knob 32 which threadably receives, and is secured by nut 31. Adapter 33 is affixed to the base of clamp 30 and serves as the attachment point for flexible support 34.

Figure 5B:
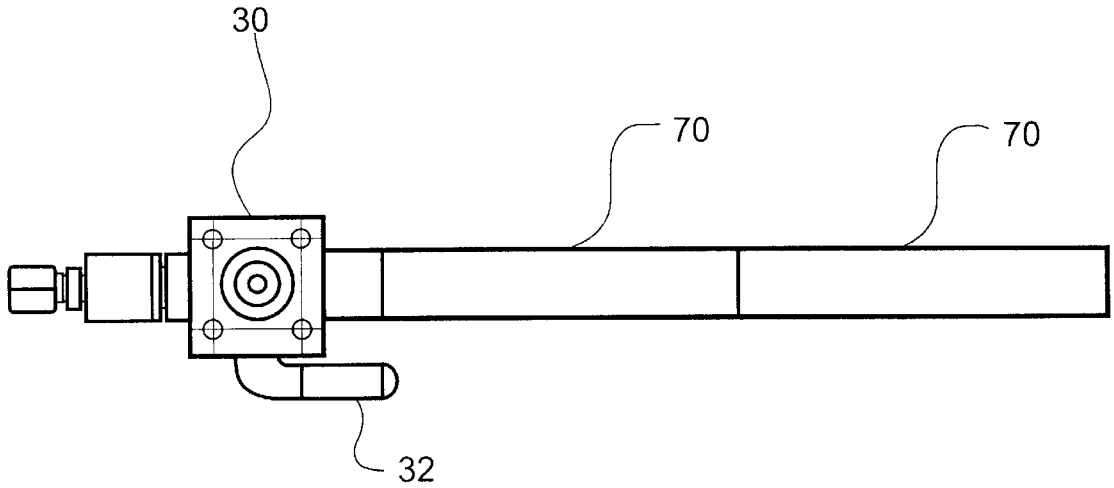
FIG. 5*b* depicts a bottom view of the device shown in FIG. 1 with two sections of extension tubing attached to the muzzle end of the barrel portion.

As shown in FIGS. 5*a* and 5*b,* two lengths of extension tubing 70 may be added to the front end of barrel 12 to extend the reach of explosives disrupter 10. Additionally, as shown in FIG. 1, standoff spokes 72 are threadably received by the front end of barrel 12 to provide distance between explosives disrupter 10 and target 80 while maintaining accuracy.

Figure 6:
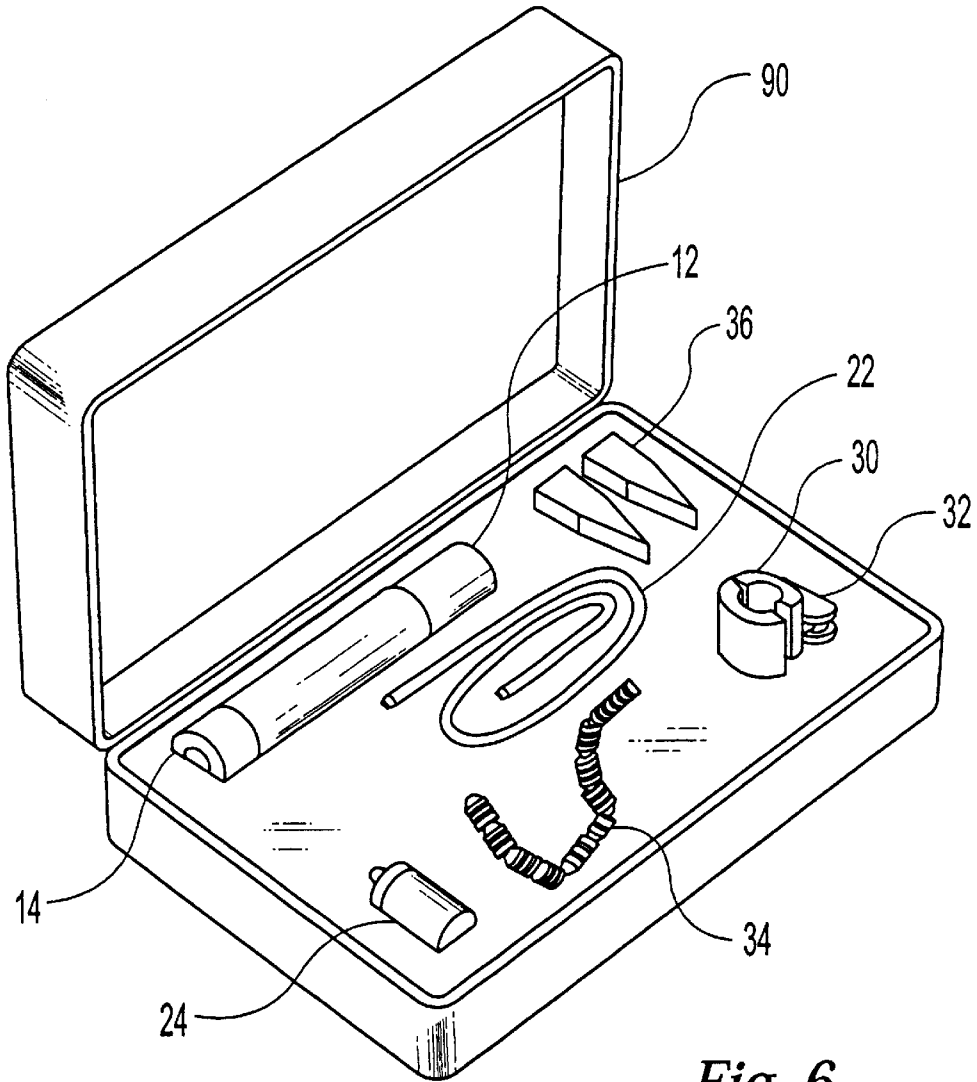
FIG. 6 depicts an embodiment of the present invention in which the various components are disassembled and placed in a portable carrying case.

The operation of explosives disrupter 10 may be described as follows. In a preferred embodiment, the individual components of explosives disrupter 10 are dissembled and packaged as a portable kit having a container 90 specifically designed to securely store the various parts of the disrupter. Shown in FIG. 6. A bomb technician may carry the kit into the field on his or her person, and upon recognition of an IED, the technician may quickly assemble the kit into an operational device using a simple tool included in the kit. Sections of flexible support 34 are joined together to achieve a desired length and attached to adapter 33 which is permanently affixed to the base of clamp 30. Barrel 12, breech 14, firing mechanism 20, union 18, and compression fitting 20 are present as a subassembly in the kit. This subassembly is secured within clamp 30 by tightening clamp knob 32. Projectile 26 is loaded into barrel 12 and either extension tubing 72, or standoff spokes 72 are threaded onto the muzzle end of barrel 12. One end of propellant conduit 22 is inserted into compression fitting 20 and union 18 and secured by tightening compression fitting 20. The other end of propellant conduit 22 is attached to charge source 24. The length of propellant conduit 22 is determined by the user at the time explosives disrupter 10 is deployed. By increasing the length of propellant conduit 22, the person using this invention can remotely fire explosives disrupter 10 from a considerable distance if so desired.

Explosives disrupter 10 is then clamped or staked to a substrate, oriented, and aimed at the desired target. Alternatively, flexible support 34 itself may be formed into a base for explosives disrupter 10 to sit on. Charge source 24 activates propellant conduit 22, or provides energy to propellant conduit 22, causing energy to travel down propellant conduit 22. This energy then causes firing mechanism 16 to overcome any resistance present and travel down cylindrical bore 46 forcibly striking the primer of projectile 26. Projectile 26 exits barrel 12 at a high velocity and severs, cuts, or jams the firing train of the improvised explosive device, thereby disabling or de-arming the device.

If firing mechanism 16 is either the firing pin or metal sphere embodiment, then shock tubing is used for propellant conduit 22, and an electrical source serves as charge source 24. If firing mechanism 16 is the firing piston embodiment, then propellant conduit 22 is a length of tubing, and an energy source sufficient to provide the required energy in the form of compressed air serves as charge source 24.

If shock tubing is used, after each successive firing, breech 14 must be removed from barrel 12 to either clean the firing pin, or replace metal sphere 50. Shock tubing can be used only once, and must be replaced after each use. If the air-pressure method of firing is used, the length of tubing used as propellant conduit 22 may be reused as often as desired.

The present invention presents many advantages over similar devices including the following: (1) compact design and flexible orientation; (2) a semi-rigid, segmented support system which allows in-line recoil to occur upon firing without affecting the accuracy of the device; (3) three possible firing mechanisms, including an explosion-free firing mechanism which enhances the overall safety of the present invention; (4) an integrated aiming system to assure accuracy; and (5) a breech and barrel design that increases the safety and durability of the device.

The present invention has the advantage of a compact, lightweight design coupled with the ability to orient the barrel of the explosives disrupter in a wide variety of positions in relation to a target. These features allow the user to easily carry the explosives disrupter kit into the field, quickly assemble the device, and then position or mount the disrupter in small, hard to reach spaces that would be inaccessible to larger devices.

Other de-arming devices are mounted on rigid bases, such as a tripod, or must sit on the ground or other surface. Such disrupters do not utilize designs which minimize the effects of recoil, and moments generated by the firing of the projectile at the target may cause the barrel or the entire device to move from its original positioning. The result of this movement is firing inaccuracy and decreased effectiveness of the device. The present invention has the advantage of a design which preserves firing accuracy as the projectile leaves the barrel of the device. In a preferred embodiment, the flexible support is constructed of individual segments that snap together in a ball and socket-type union or joint. This segmented support is semi-rigid, meaning that it is sufficiently inflexible to provide stability and support to the barrel, and hold the barrel in place when aimed at a target, yet when the explosives disrupter is fired, the flexible support yields to the recoil generated by the disrupter. Each of the multiple joints between the individual segments of the flexible support moves a short distance when the disrupter is fired, effectively absorbing the recoil generated as the projectile travels down the length of the barrel.

The present invention also has the advantage of providing the user with three different firing mechanisms. In one embodiment, the present invention uses a firing pin and explosive tubing combination to discharge the projectile from the barrel of the device. In another embodiment, the present invention uses a metal sphere and explosive tubing combination to discharge the projectile from the barrel of the device. In still another embodiment the present invention uses a compressed air and firing piston mechanism to discharge the projectile from the barrel of the device. Use of a metal sphere in the place of a firing pin is advantageous because the sphere is easily fabricated, i.e., an ordinary BB may be used, and the sphere may be replaced with each use thereby eliminating the need to clean the firing mechanism after each firing. Additionally, a reusable compressed air firing mechanism is more economical than a single-use explosive tubing mechanism. Furthermore, the enhanced safety aspects of a compressed air system make the present invention less likely to cause collateral damage because utilization of compressed air assures that the device has no energy to fire until the air source is connected and actuated.

Further advantages of this invention include low cost aiming devices integrated into the design of the device.

Threaded wire (e.g. bicycle spokes) can be inserted into to the muzzle end of the barrel to allow the barrel to stand off from a particular target when the user wishes to maintain a distance from the target. Aiming the device is also facilitated by sliding extension tubes over either the front or rear end of the device. These extension tubes allow the barrel to be extended into small or difficult to reach areas that would otherwise be inaccessible.

The breech and barrel design of the present invention are inverted over that usually found in a conventional firearm; the breech is threaded into the rear of the barrel, as opposed to threading around the barrel. This design advantage allows the barrel thickness to be minimized because there are no threads in the region of the barrel where radial pressure is generated during the firing of the projectile. Furthermore, the threads on the breech must only withstand axial forces, thereby improving the safety of the present invention by minimizing the risk of the barrel and/or breech fracturing during operation. This design also permits a constant diameter between the breech and barrel which facilitates attachment of the extension tubes as well as facilitating placement of the device in the orienting snake assembly.

While the above description contains many specificities, these should not be construed as limitations on the scope of the invention, but rather as exemplification of preferred embodiments. Numerous other variations of the present invention are possible, and it is not intended herein to mention all of the possible equivalent forms or ramifications of this invention. Various changes may be made to the present invention without departing from the scope of the invention, and the following are examples of such changes.

A preferred embodiment of the present invention contemplates a device for use against small improvised explosive devices such as letter bombs, or small ordnance such as land mines or grenades. However, in another embodiment the present invention is scaled-up and modified to be used against larger ordnance such complex bombs or missiles. The same principles of flexibility and recoilless operation found in the present invention apply to larger disrupter devices.

In a preferred embodiment of the present invention, barrel 12 is a smooth-bore barrel; however, in another embodiment the barrel is rifled to increase the accuracy of explosives disrupter 10 if the distance between the explosives disrupter and the target is increased.

Figure 7:
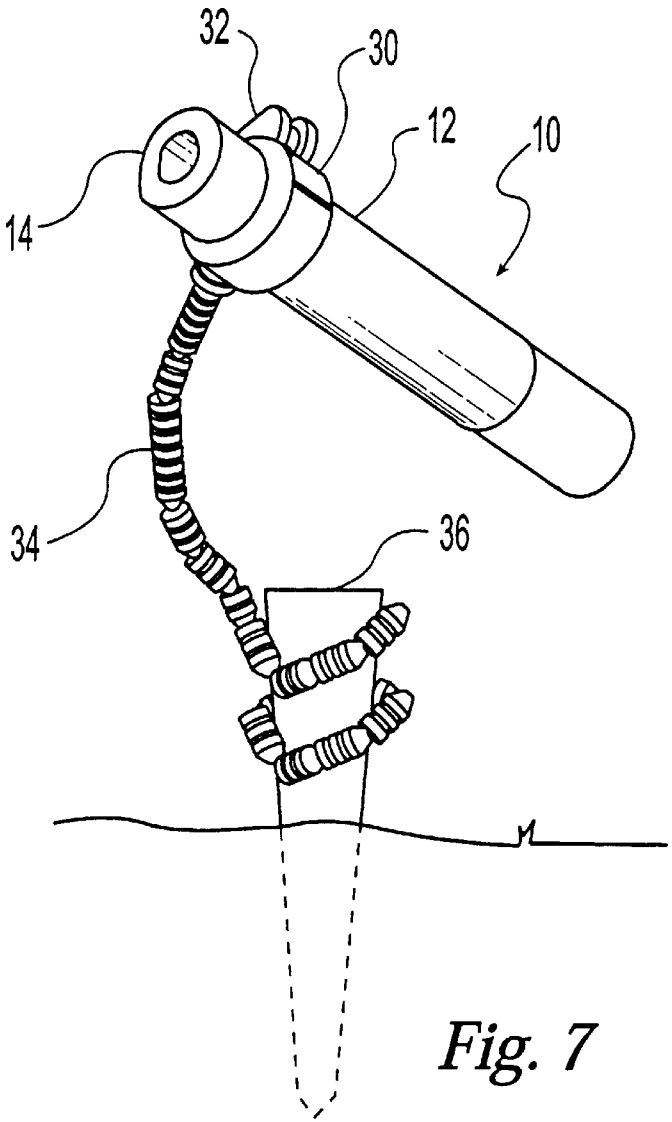
FIG. 7 is a perspective view of the assembled device according to the teachings of the present invention. In this illustration, the explosives disrupter has been attached to a stake and oriented toward, and aimed at, the target.

To withstand the normal firing pressures of the present invention, the preferred material for both the barrel and the breech is metal. However, other structural components of the present invention can be fabricated from a wide variety of materials. Clamp 30, nut 31, clamp knob 32, and adapter 34 may be fabricated from polymer, plastic, or a variety of suitable metals such as aluminum or stainless steel. If a securing clamp 30 or stakes 36 (shown in FIG. 7) are used to secure this invention against a solid substrate, such items may also be fabricated from polymer, plastic, or a variety of suitable metals such as aluminum or stainless steel.

In a preferred embodiment, projectile 26 is a 9 mm bullet. In other embodiments projectile 26 is a 0.22, 0.38, 0.45, or other suitable small caliber bullet. In another embodiment of the present invention, projectile 26 is a shotgun shell. In still another embodiment, projectile 26 is a large caliber projectile.

In one embodiment requiring shock tubing, Nonel™, a commercially available product, is used as propellant conduit 22. In another embodiment requiring shock tubing, any acceptable explosive tubing capable of transferring the required energy is used as propellant conduit 22. In one embodiment requiring air-pressure, propellant conduit 22 is Tygon™ tubing. In another embodiment requiring air pressure, propellant conduit 22 is plastic, polyethylene, or polypropylene tubing.

In an embodiment of the present invention requiring an electrical charge source, charge source 24 is an electric battery. In another embodiment requiring an electrical charge source, charge source 24 is any electrical source which will provide the charge necessary to activate the shock tubing. In one embodiment of the present invention requiring air pressure, charge source 24 is a manually-operated air pump such as a bicycle pump, or an electrically operated air compressor. In another embodiment of the present invention requiring air pressure, charge source 24 is a cylinder of gas such as a carbon dioxide or nitrous oxide. In a preferred embodiment of the present invention, flexible support 34 is the commercial product Loc-Line™, which is a segmented plastic tube that can easily be assembled and bent into a desired shape, with such shape being retained. Another embodiment of the present invention replaces Loc-Line™ with any flexible tubing or conduit that will provide flexibility, stability, and in-line recoil. Still another embodiment of the present invention utilizes any flexible, segmented material that when assembled to a desired length provides flexibility and also minimizes the effects of recoil on the accuracy of the device.

We claim:

1. A remotely-activated projectile firing device, comprising:

a barrel for housing a projectile;

a breech connected to one end of the barrel;

a firing mechanism contained within the breech;

triggering means in communication with the firing mechanism via a conduit; and an elongate, semi-rigid, three-dimensionally flexible recoil-absorbing orientation system attached to the barrel, wherein upon discharge, the device recoils in a substantially in-line manner, the orientation system comprising a plurality of individual segments, joined together in a ball-and-socket-type connection, which may be assembled to a desired length.

2. The projectile-firing device of claim 1, further comprising a clamp for attaching the orientation system to the device.

3. The projectile-firing device of claim 1, wherein the projectile is chosen from the group consisting of, solid sphere, bullet, and shot.

4. A remotely-activated explosives disrupter for de-arming explosive devices, comprising:

a barrel for housing a projectile, the barrel having a muzzle end;

a breech connected to an end of the barrel distal to the muzzle end;

a firing mechanism residing within the breech;

triggering means in communication with the firing mechanism via a conduit; and an elongate, semi-rigid, three-dimensionally flexible, recoil-absorbing orientation system attached to the barrel, upon discharge, the device recoils in a substantially in-line manner, the orientation system comprising a plurality of individual segments, joined together in a ball-and-socket-type connection, which may be assembled to a desired length.

5. The explosives disrupter of claim 4, wherein the orientation system is attached to the disrupter with a clamp.

6. The explosives disrupter of claim 4, further comprising a projectile, wherein the projectile is chosen from the group consisting of a solid sphere, bullets, and shot.

7. The explosives disrupter of claim 4, further comprising at least one extension tube attached to the muzzle end of the barrel, the extension tube having an inside diameter greater than the inside diameter of the barrel.

8. The explosives disrupter of claim 4, further comprising one or more standoff spokes attached to the muzzle end of the barrel.

9. The explosives disrupter of claim 5, wherein the breech and the barrel maintain a substantially constant outside diameter.

10. A method for remotely firing a projectile into a target comprising the steps of:

(a) assembling a portable apparatus, the portable apparatus comprising:
  (i) a barrel;
  (ii) a firing mechanism for is discharging the projectile from the barrel;
  (iii) a power source for remotely the firing mechanism, the power source in communication with the firing mechanism via a conduit; and
  (iv) an elongate, semi-rigid, three-dimensionally flexible recoil-absorbing orientation system attached to the barrel, the orientation system comprising a plurality of individual segments, joined together in a ball-and-socket-type connection, which may be assembled to a desired length;

(b) inserting the projectile into the barrel;

(c) orienting the apparatus relative to the target; and (d) transferring energy from the power source to the firing mechanism via the conduit, whereby the firing mechanism is activated and the projectile is discharged from the barrel into the object, and whereby the apparatus recoils in a substantially in-line manner.

11. A kit for remotely firing a projectile into an object, comprising:

(a) an apparatus, the apparatus further comprising:
  (i) a barrel;
  (ii) a breech connected to the barrel;
  (iii) a firing mechanism housed within the breech;
  (iv) a conduit for remotely transferring energy to the firing mechanism; and
  (v) a charge source for supplying energy to the propellant conduit;

(b) an elongate, semi-rigid, three-dimensionally flexible recoil-absorbing orientation system, the orientation system comprising a plurality of individual segments, joined together in a ball-and-socket-type connection, which may be assembled to a desired length;

(c) one or more stabilizing stakes;

(d) a tool for rapidly assembling the apparatus;

(e) one or more aiming means;

(f) a container for securely storing, in a disassembled state, the apparatus, the aiming means, the stabilizing stakes, and the assembly tool, wherein the container is fabricated to be carried by the user of the kit.

* * * * *